United States Patent [19]

Thuries et al.

[11] Patent Number: 4,996,399

[45] Date of Patent: Feb. 26, 1991

[54] HIGH OR MEDIUM TENSION CIRCUIT BREAKER

[75] Inventors: Edmond Thuries, Pusignan; Denis Dufournet, Bron; Michel Perret, Tramole, all of France

[73] Assignee: GEC Alsthom SA, Paris, France

[21] Appl. No.: 547,276

[22] Filed: Jul. 3, 1990

[30] Foreign Application Priority Data

Jul. 4, 1989 [FR] France ..... 89 08975

[51] Int. Cl.[5] ..... H01H 33/88

[52] U.S. Cl. ..... 200/148 A; 200/148 R

[58] Field of Search ..... 200/148 A, 148 R

[56] References Cited

U.S. PATENT DOCUMENTS 2,666,118 1/1954 Ludwig et al. ..... 200/150

FOREIGN PATENT DOCUMENTS 0302390 2/1989 European Pat. Off. .
2403300 7/1975 Fed. Rep. of Germany .
2575595 7/1986 France .
2610763 8/1988 France .

*Primary Examiner*—Robert S. Macon

*Attorney, Agent, or Firm*—Sughrue, Mion, Zinn, Macpeak & Seas

[57] ABSTRACT

A circuit breaker for high and medium tension including insulation by means of a dielectric gas and puffer arc blasting, the circuit breaker comprising a gastight insulating casing, containing:

a fixed assembly comprising, in particular, a fixed main contact and a fixed arcing contact;

a moving assembly driven by a drive rod and including, in particular, a moving main contact and a moving arcing contact;

a first blast volume extended by a blast nozzle;

a blast piston; and first and second secondary contacts disposed inside a second volume and designed to strike a secondary arc;

wherein the first secondary contact is fixed relative to the fixed assembly, the second secondary contact being semi-moving relative to the moving assembly, possessing its own source of energy for displacing it during a circuit breaker disengagement operation, and being provided with means for conferring a shorter stroke thereto than the stroke of the moving assembly.

4 Claims, 2 Drawing Sheets

HIGH OR MEDIUM TENSION CIRCUIT BREAKER

The present invention relates to a circuit breaker usable at high or medium tension, in which the interrupting chamber is filled with a dielectric gas such as sulfur hexafluoride ($SF_6$) and in which the energy of the arc is used via the rise in pressure that it causes in the gas, firstly to blast the arc which is struck on the arcing contacts separating, and secondly to provide additional energy to the circuit breaker opening mechanism.

BACKGROUND OF THE INVENTION

These objects are achieved, for example, by providing the circuit breaker with a pair of additional contacts capable of generating a secondary arc during circuit breaker opening.

For example, a circuit breaker of this type is described in published German patent application No. 2 349 263.

A drawback of the prior art circuit breaker is the increase in the weight of the moving equipment due to the presence of one of the secondary contacts. This increase in weight means that the circuit breaker must be provided with a more powerful control mechanism, thereby increasing the cost of the apparatus.

An object of the invention is to provide a circuit breaker having secondary contacts, but in which the weight of the moving equipment is not increased.

Another object of the invention is to provide a circuit breaker which is compact, and therefore cheap to build and having low maintenance costs.

Document DE-A-2 403 300 describes a circuit breaker provided with secondary contacts. One of them, the secondary contact farther from the blast nozzle, is fixed to the moving equipment, while the other one of them is semi-moving relative to the fixed equipment. Such a circuit breaker suffers from a drawback: the length of the secondary arc is not necessary limited; as a result, the arc may lengthen excessively during a circuit breaker opening operation, thereby overheating the surrounding gas; such overheating may prevent the circuit breaker from performing a rapid open-close-open (OCO) cycle since the gas does not have time to cool down sufficiently after the first open; consequently the medium remains highly ionized and the second open operation may fail since the secondary arc does not extinguish during the current zero crossing.

Another drawback of excessively lengthening the arc is that the arc may damage the parts surrounding it.

An additional object of the present invention is to provide a circuit breaker which does not have the above-mentioned drawbacks.

SUMMARY OF THE INVENTION

The present invention provides a circuit breaker for high and medium tension including insulation by means of a dielectric gas and puffer arc blasting, the circuit breaker comprising a gastight insulating casing, containing:

- a fixed assembly comprising, in particular, a fixed main contact and a fixed arcing contact;
- a moving assembly driven by a drive rod and including, in particular, a moving main contact and a moving arcing contact;
- a first blast volume extended by a blast nozzle;
- a blast piston; and

- first and second contacts disposed inside a second volume and designed to strike a secondary arc;
- wherein the first secondary contact is fixed relative to the fixed assembly, the second secondary contact being semi-moving relative to the moving assembly, possessing its own source of energy for displacing it during a circuit breaker disengagement operation, and being provided with means for conferring a shorter stroke thereto than the stroke of the moving assembly.

Advantageously, said second secondary contact is the further of the secondary contacts from the blast nozzle when the circuit breaker is in the open position.

Preferably, said source of energy is a spring put into compression during an engagement operation of the circuit breaker.

Advantageously, the means for limiting the stroke of the second secondary contact is constituted by an abutment coming into contact with the fixed piston.

BRIEF DESCRIPTION OF THE DRAWINGS

An embodiment of the invention is described by way of example with reference to the accompanying drawings, in which.

DETAILED DESCRIPTION

Figure 1:
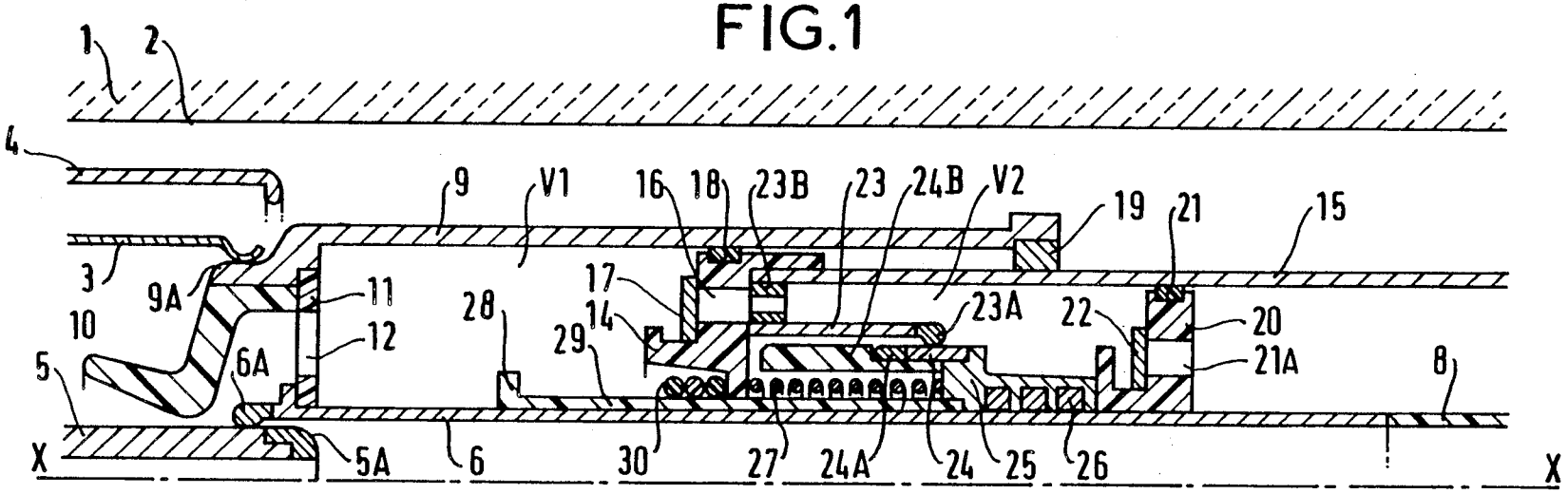
FIG. 1 is an axial half-section view through a circuit breaker of the invention, shown in the engaged position.
Figure 2:
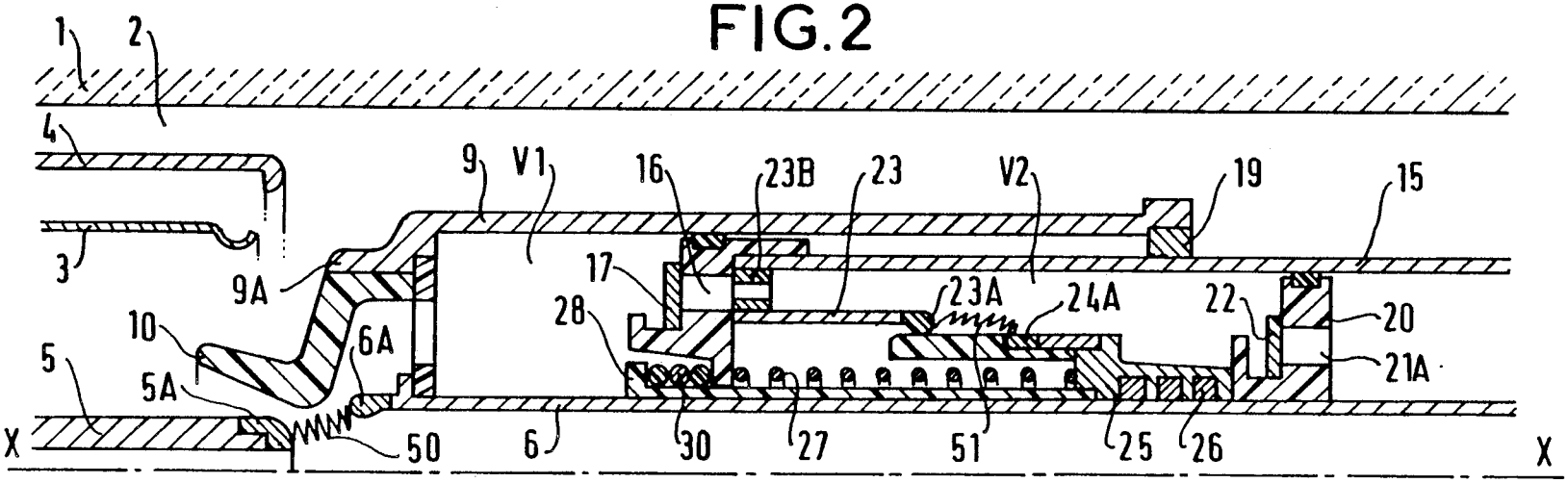
FIG. 2 is an axial half-section view through the same circuit breaker during a circuit-breaking operation.

In FIG. 1, reference 1 designates a cylindrical casing about an axis xx, made of an insulating material such as a ceramic, and delimiting an inside volume 2 which is filled with a gas having good dielectric properties, such as sulfur hexafluoride ($SF_6$), at a pressure of a few bars.

The components inside the interrupting chamber are circularly symmetrical about the axis xx, thereby ensuring that the apparatus is compact and facilitating assembly and maintenance.

The circuit breaker includes a fixed main contact 3 constituted by a set of fingers in a tulip-like socket configuration. This contact is surrounded by an anti-corona cap 4. The main contact 3 is associated with a fixed arcing contact constituted by a metal tube 5 terminated by a part 5A made of a material which withstands the effects of arcing, e.g. a tungsten-based alloy. The two above-mentioned fixed contacts are electrically connected to a first current terminal (not shown).

The moving equipment comprises a metal tube 6 terminated by a wear piece 6A constituting the moving arcing contact. This tube is connected to a rod 8 made of insulating material and used for driving the disengagement and re-engagement operations of the circuit breaker.

The moving equipment also includes a tube 9 about the axis xx, having a smaller diameter portion 9A at one end constituting the moving main contact. This portion also serves as a support for a blast nozzle 10 made of an insulating material such as polytetrafluoroethylene. The tube 6 and the tube 9 are held together by an insulating ring 11 pierced by large orifices 12. The tube 6 and the tube 9 delimit an annular volume V1 constituting the arc blast volume.

This volume is closed at tis end farther from the nozzle 10 by a first piston 14 which if fixed, made of an insulating material and held by a tube 15 which is coaxial with the tube 9 and connected to a second terminal (not shown) of the circuit breaker. The piston 14 is pierced by orifices 16 suitable for being closed by a washer 17 constituting a differential valve. Sealing between the piston 14 and the tube 9 is obtained by means of an annular piston ring seal 18.

Electrical connection is ensured between the tube 9 and the tube 15 by sliding electrical contacts 19.

To the right of the piston 14, the tubes 15 and 16 delimit a volume V2 of annular section in which the secondary contacts are disposed. This volume is closed by a second piston 20 made of insulating material and fixed to the tube 6. This piston slides in sealed manner along the tube 15 by means of a piston ring type seal 21. The piston 20 is pierced by orifices 21A suitable for being closed by a washer 22 constituting a non-return valve.

Figure 3:
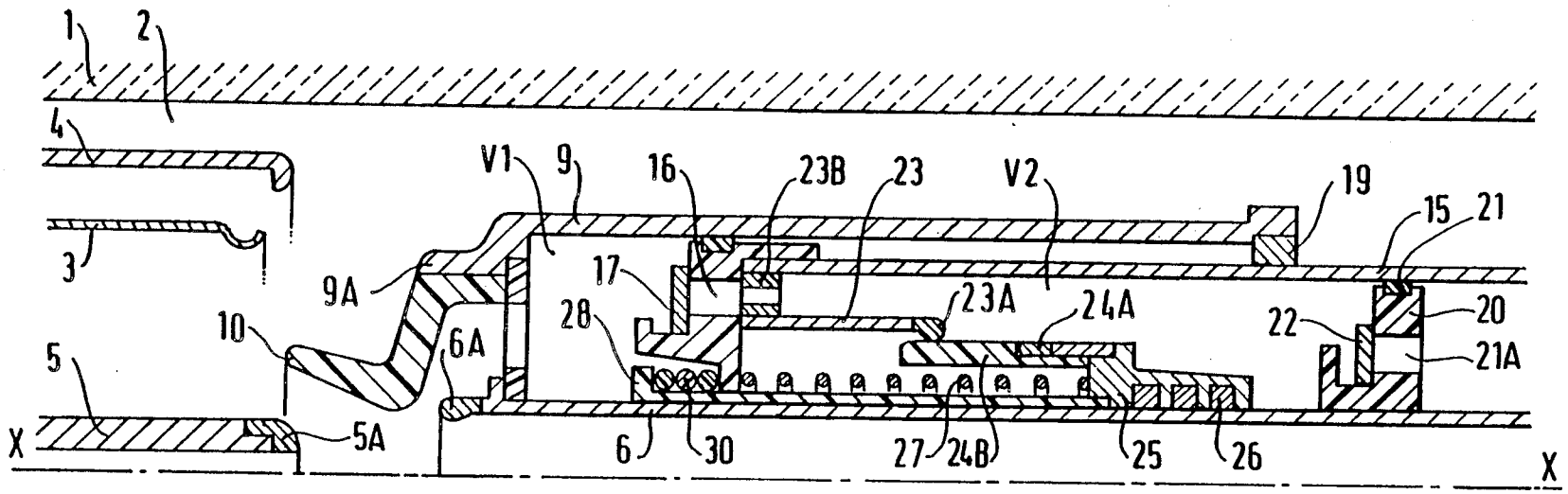
FIG. 3 is an axial half-section view through the same circuit breaker at the end of a circuit-breaking operation.

A first secondary contact, closer to the blast nozzle when the circuit breaker is in the open position (as shown in FIG. 3), is constituted by a tube 23 fixed to the first piston 14 and thus to the fixed assembly. This tube about the axis xx is terminated by a wear part 23A, and is electrically connected to the tube 15, e.g. via a metal ring 23B pierced by holes in line with the holes 16.

The other secondary contact, which is farther from the blast nozzle when the circuit breaker is in the open position, is a tube 24 which is terminated by a wear part 24A. This tube is coaxial with the tube 23 and is of smaller diameter so as to be capable of engaging therein when the circuit breaker is in the engaged position, and it is fixed to an annular metal block 25 capable of sliding freely on the tube 6. Sliding electrical contacts 26 provide electrical contacts between the tube 6 and the part 25.

A spring 27 is disposed between the block 25 and the fixed piston 14. It is compressed when the circuit breaker is in the engaged position. The stroke of the block 25 is limited by an abutment 28 constituting an integral portion of a tube 29 made of insulating material and capable of sliding along the tube 6 and which surrounds a fraction of the length of said tube 6. The function of the tube 29 is explained below.

The contact 24 is extended by a tube 24B made of insulating material (e.g. polytetrafluoroethylene) and its function appears below.

The assembly constituted by the block 25, the contact 24, the tube 29, and the contacts 26 may be called "semi-moving" since it is capable of performing displacements of limited amplitude relative to the moving assembly.

A damper, 30, e.g. made of elastomer material, serves to damp motion of the semi-moving assembly. In a variant, a different type of damper could be used, e.g. a pneumatic shock absorber.

The operation of the circuit breaker is now described.

During normal operation of the line in which the circuit breaker is inserted, the circuit breaker is in the engaged position (FIG. 1) and the nominal current passes via the fingers 3, the tube 9A-9, the contacts 19, and the tube 15.

In order to open the circuit breaker, e.g. on a fault, the drive rod is displaced to the right in the figure by a drive mechanism (not shown). The main contacts 3 and 9A separate, and the current switches to flow via the arcing contact, i.e. along the tube 5, the tube 6, the contacts 26, the block 24, the secondary contact 23, the ring 23B, and the tube 15.

When the arcing contacts separate, an arc 50 is struck between the ends 5A and 6A. The pressure inside the volume V1 increases firstly because of the mechanical effect due to the relative displacement of the piston 14 and the cylinder 9, and secondly because of the rise in the temperature of the gas heated by the arc. The differential valve 17 closes the volume V1 since the pressure inside this volume is higher than the pressure inside the volume V2. The current continues to follow the same path, except insofar as that path now includes the arc 50.

During this stage, the semi-moving assembly moves together with the moving assembly under thrust from the expanding spring.

As the stroke of the rube 6 continues, the secondary contacts 23A and 24A separate. An arc 51 is struck between them. The striking of this arc is facilitated by the presence of the PTFE tube 24B due to the decomposition which encourages gas ionization. The pressure inside the volume V2 increases rapidly, thereby providing a considerable contribution to the energy required for driving the circuit breaker to the open position. During this stage, the valve 22 remains closed as does the valve 17 since the area of the valve 17 is much larger than the sum of the areas of the orifices 16.

After a stroke of limited length, the secondary contact 24 comes to rest, since the abutment 28 comes onto contact with the piston 14 via the damper 30.

By virtue of this disposition, the length of the secondary arc is limited so there is no danger of the gas inside the volume V2 overheating, nor is there any danger of the parts delimiting this volume being damaged by the secondary arc straying.

After the secondary contact has come to rest, the moving equipment continues its stroke (FIG. 3).

The first time the current passes through zero, the arc 50 is extinguished by the energetic blast coming from the volume V1 through the blast nozzle 10.

The various components of the circuit breaker may be given dimensions such that the main arc 50 and the secondary arc 51 appear at substantially the same time.

The circuit breaker is compact in construction and it is easy to maintain. It is applicable to medium tension and to high tension networks.

We claim:

1. A circuit breaker for high and medium tension including insulation by means of a dielectric gas a puffer arc blasting, the circuit breaker comprising a gastight insulating casing, containing:

a fixed assembly comprising, in particular, a fixed main contact and a fixed arcing contact;

a moving assembly driven by a drive rod and including, in particular, a moving main contact and a moving arcing contact;

a first blast volume extended by a blast nozzle;

a blast piston; and first and second secondary contacts disposed inside a second volume and designed to strike a secondary arc;

wherein the first secondary contact is fixed relative to the fixed assembly, the second secondary contact being semi-moving relative to the moving assembly, possessing its own source of energy for displacing it during a circuit breaker disengagement operation, and being provided with means for conferring a shorter stroke thereto than the stroke of the moving assembly.

2. A circuit breaker according to claim 1, wherein said second secondary contact is the farther of the secondary contacts from the blast nozzle when the circuit breaker is in the open position.

3. A circuit breaker according to claim 1, wherein said source of energy is a spring put into compression during an engagement operation of the circuit breaker.

4. A circuit breaker according to claim 1, wherein the means for limiting the stroke of the second secondary contact is constituted by an abutment coming into contact with the fixed piston.

* * * * *